United States Patent [19]

Levkov

[11] 4,438,641

[45] Mar. 27, 1984

[54] SHIELDED LOCK ASSEMBLY

[76] Inventor: Ilya I. Levkov, 321 W. 94 St., Apt. 6NW, New York, N.Y. 10025

[21] Appl. No.: 310,058

[22] Filed: Oct. 9, 1981

[51] Int. Cl.[3] ..... E05B 65/52; E05B 67/38; E05B 65/08

[52] U.S. Cl. ..... 70/95; 70/34; 70/54; 70/417

[58] Field of Search ..... 70/32–34, 70/95–100, 416–418, 54–56; 292/346, 281

[56] References Cited

U.S. PATENT DOCUMENTS

| | | | |
|---|---|---|---|
| 2,766,605 | 10/1956 | O'Brien | 70/417 |
| 3,572,062 | 3/1971 | Beebe | 70/1.5 |
| 3,652,114 | 3/1972 | Cady | 292/281 |
| 3,718,014 | 2/1973 | Delgadillo | 70/56 |
| 3,727,438 | 4/1973 | Knaack | 70/63 |
| 3,731,506 | 5/1973 | Greene | 70/97 |
| 3,787,082 | 1/1974 | Foote | 292/281 |
| 3,796,071 | 3/1974 | Crepinsek | 70/32 |
| 3,820,360 | 6/1974 | Best | 70/32 |
| 3,916,654 | 11/1975 | Mudge | 70/56 |
| 4,102,161 | 7/1978 | Proefrock | 70/42 |
| 4,106,315 | 8/1978 | Dohanyos | 70/56 |

*Primary Examiner*—Robert L. Wolfe
*Attorney, Agent, or Firm*—James & Franklin

[57] ABSTRACT

A shielded lock assembly suitable for joining first and second members together comprises in combination a shackle-bearing element having a body portion and a shackle carried thereby, and a lock body having a keyhole and having a shackle-receiving aperture opening in a given direction and adapted to receive and releasably retain the shackle therein. A housing is adapted to be secured to the first member, said housing defining an enclosure adapted to receive the lock body and having access openings communicating with the aperture and the keyhole, respectively. Means are operatively connected to the housing and engageable with the lock body for retaining the lock body in the enclosure. The shackle-bearing element is adapted to be secured to the second member such that the shackle is aligned with and enters the aperture as the first and second members approach each other, the body portion thereof being configured and dimensioned to then cover substantially all portions of the aperture access opening in the housing not occupied by the shackle.

14 Claims, 4 Drawing Figures

FIG-1
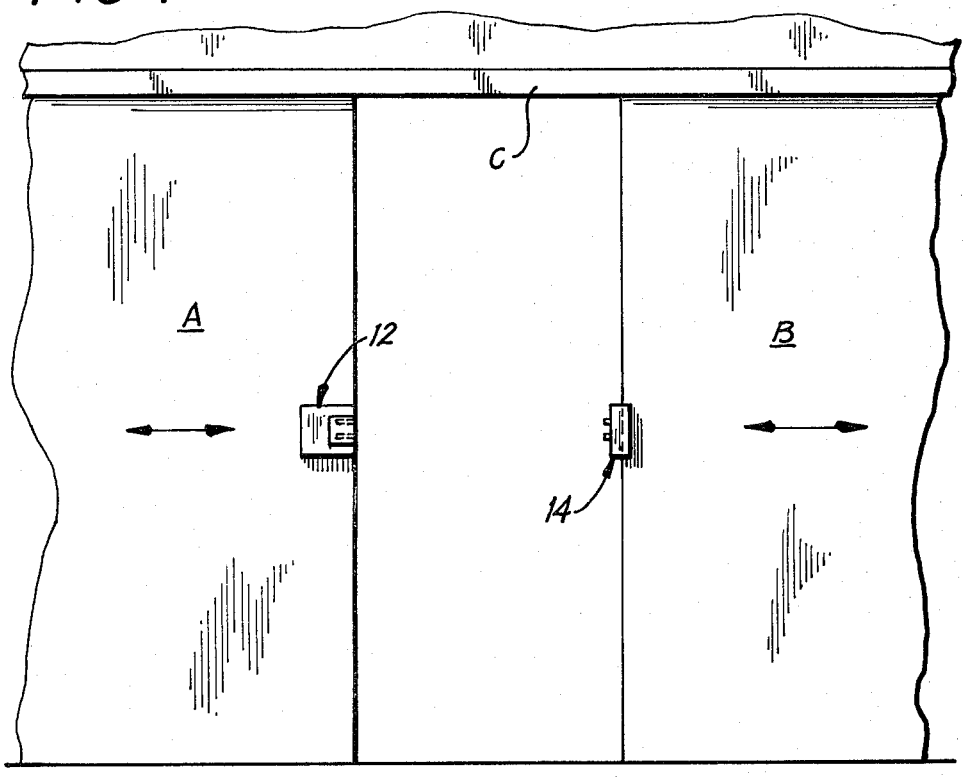
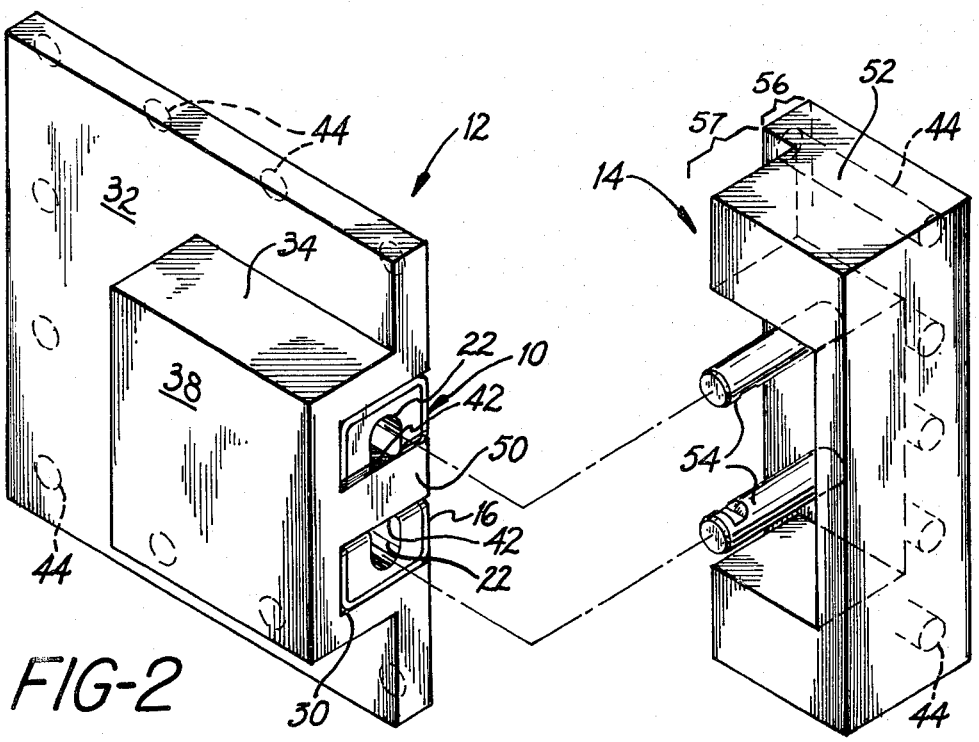
FIG-2

SHIELDED LOCK ASSEMBLY

BACKGROUND OF THE INVENTION

The present invention relates to a shielded lock assembly, and more particularly to a shielded lock assembly wherein the shackle and lock body are shielded to render more difficult destructive access thereto.

A key-operated lock will always be subject to attack by thieves and the like via the keyhole, and the present invention is not intended to ameliorate that problem. However, lock assemblies comprised of a lock body and a shackle are subject to attack—even when made of case hardened steel—by cutting or severing of the shackle or lock body by means of a bolt cutter or chisel or the like.

The prior art evidences numerous attempts to protect the lock body and shackle (exclusive of the keyhole) against destructive access by enclosing as much of the lock body and shackle as possible in a virtually indestructible housing of case hardened steel. See, for example, U.S. Pat. No. 4,106,315. However none of the known approaches have provided such complete protection for the lock body and shackle that it could be truly said to limit access to attack on the keyhole.

Accordingly, it is an object of the present invention to provide a lock assembly which is shielded sufficiently to substantially limit to the keyhole any destructive access to the lock body or shackle.

Another object is to provide such a shielded lock assembly wherein the lock body is replaceable.

It is also an object to provide such a shielded lock assembly which is easy to manufacture, easy to install and reliable in operation.

SUMMARY OF THE INVENTION

It has now been found that the above and related objects of the present invention are obtained in a shielded lock assembly, suitable for joining first and second members together comprising in combination a shackle-bearing element and a lock body. The shackle-bearing element has a body portion and a shackle carried thereby, and the lock body has a keyhole and a shackle-receiving aperture opening in a given direction and adapted to receive and releasably retain the shackle therein. A housing is adapted to be secured to the first member and defines an enclosure, the enclosure being adapted to receive the lock body and have access openings communicating with the shackle-receiving aperture and the keyhole, respectively. Means are operatively connected to the housing and engageable with the lock body for retaining the lock body in the enclosure. The shackle-bearing element is adapted to be secured to the second member so that the shackle is aligned with and enters the shackle-receiving aperture as the first and second members approach each other. The body portion of the shackle-bearing element is configured and dimensioned to then cover substantially all portions of the aperture access opening in the housing not occupied by the shackle.

In a preferred embodiment, the housing enclosure is open at one side and adapted to be closed at such one side by the first member when the housing is secured thereto. Thus the lock body is maintained within the enclosure by the first member when the housing is secured to the first member and is removable from the housing when the housing is not secured to the first member.

The enclosure is open in the given direction, thereby at least in part defining the aperture access opening, and the retaining means limits movement of the lock body in the given direction. Accordingly when the housing is secured to the first member and the shackle-receiving aperture receives the shackle, the shackle-bearing element substantially closes the enclosure except for the keyhole access opening.

More particularly, the housing preferably has at least two spaced apart side walls, a back wall joining the side walls, and an outer wall joining the back and side walls, the various walls cooperatively defining the enclosure. The retaining means comprises a lug extending inwardly from the outer wall at a point spaced forwardly from the back wall. Typically the lug is disposed intermediate a pair of the shackle-receiving apertures. Preferably the element body portion overlaps a portion of the side and outer walls of the housing when the shackle enters the shackle-receiving aperture.

In a preferred embodiment the housing further defines a substantially planar inner wall, the back and side walls being upstanding from the inner wall. The retaining means comprises a lug extending from the outer wall towards the plane of the inner wall, the inner wall being cut away to enable direct contact between the lock body and the first member, and the element body portion overlapping portions of the inner, side and outer walls.

BRIEF DESCRIPTION OF THE DRAWING

FIG. 1 is a fragmentary front view of the shielded lock assembly of the present invention in place on a pair of sliding doors;

FIG. 2 is a partially exploded isometric view of the elements of the shielded lock assembly of FIG. 1;

DETAILED DESCRIPTION OF THE PREFERRED EMBODIMENTS

Figure 3:
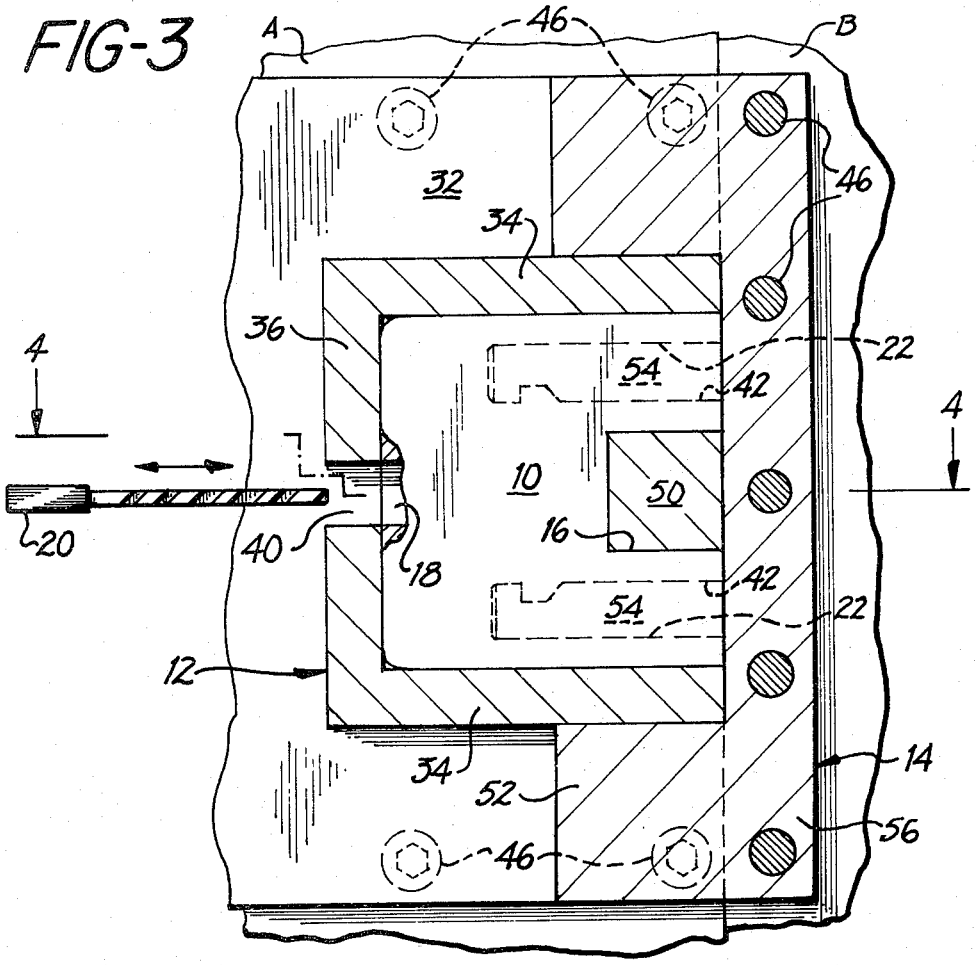
FIG. 3 is a fragmentary sectional front view of the lock assembly of FIG. 1 and a key therefor.

Referring now to the drawing, and in particular to FIG. 1 thereof, therein illustrated is a preferred embodiment of the present invention, shown in a typical environment during use. Illustrated are a pair of sliding doors A, B, both of which approach and retreat from each other horizontally in substantially the same plane during the closing and opening processes, riding in guides C. The shielded lock assembly of the present invention is especially suited for use with two members A, B which approach each other in substantially the same plane, such as the sliding doors frequently found in factories, warehouses and other commercial establishments, but also found in some homes. The doors may approach each other either vertically or, as illustrated, horizontally, and there may be only one door and a fixed member or, as illustrated, two doors, both of which approach and retreat from each other during the closing and opening processes as indicated by the arrows. It should further be appreciated that one or both doors may be either flexible or composed of articulated members so that, as they retreat from one another during the opening process, one or both are rolled into a different plane, like a garage door which is lifted into a position substantially parallel to the roof of the garage during the opening process.

Figure 4:
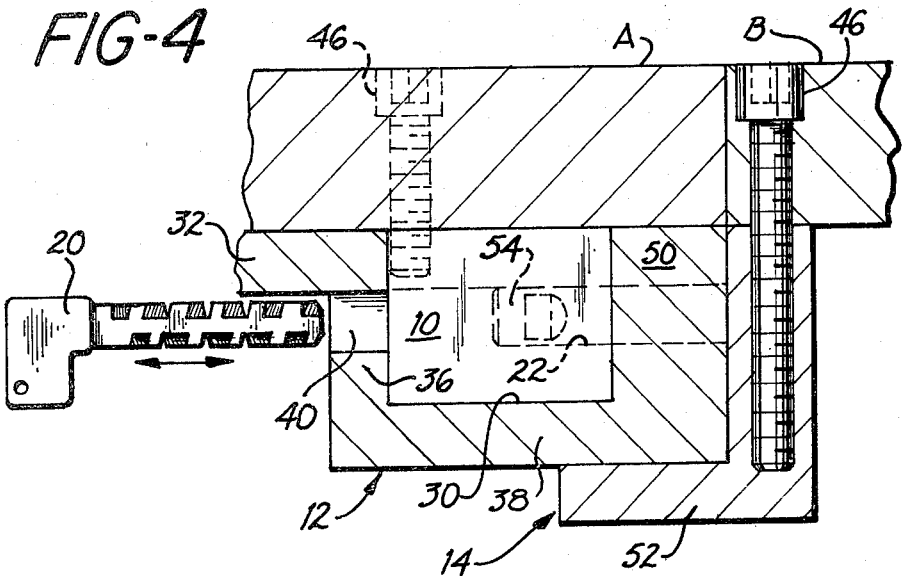
FIG. 4 is a top sectional view taken along the line 4—4 of FIG. 3.

Referring now in particular to FIGS. 2–4, the present invention comprises generally a lock body, generally designated by the numeral 10, a housing for the lock body, generally designated 12 and a shackle-bearing element generally designated by the numeral 14.

The lock body 10 may be conventional in design although it is preferably formed of case hardened steel for strength. A preferred lock is Manolex Series 100, available from Amlev International Corp., located in New York. This lock is substantially rectangular in outline except that the front thereof contains centrally disposed recess 16. Further, the lock body 10 comprises a keyhole 18, a key 20 inserted into the keyhole 18 (see arrows of FIGS. 3–4) being sufficient to open the lock body 10 without any rotation of the key. At the front of the lock body 10 are a pair of spaced apart forwardly opening shackle-receiving apertures 22, insertion of a shackle into the lock body 10 being sufficient to cause the lock body 10 to releasably retain the shackle until it is released with the key 20. It should be appreciated that while the keyhole 18 is disposed in the rear of the lock body 10 in the illustrated embodiment, the keyhole 18 could be located elsewhere on the lock body 10. Similarly, while in the illustrated embodiment the shackle-receiving apertures 22 are disclosed on either side of a recess 16, instead of the recess 16 a lock body 10 may have an opening extending therethrough disposed intermediate the front and rear walls thereof (say, in the center thereof), so that the shackle-receiving apertures 22 will not be disposed immediately on each recess side.

The housing 12 defines an enclosure 30 adapted to receive the lock body 10. The housing includes a substantially planar inner wall 32 by which the housing is secured to member A, a pair of parallel side walls 34 projecting outwardly therefrom, a back wall 36 connecting the side walls 34 and also projecting outwardly from the inner wall 32, and an outer wall 38 which is substantially parallel to the inner wall 32 and connects the side walls 34 and back wall 36. The enclosure 30 further defines three access openings, a keyhole access opening 40 operatively communicating with the keyhole 18 of lock body 10 and a pair of aperture access openings 42 operatively communicating with the shackle-receiving apertures 22 of lock body 10. While the access openings 42 will always be disclosed in the front of the enclosure 30, the keyhole access opening 40 will typically be disposed in either the outer wall 38 or, as illustrated, the back wall 36, depending on the lock used.

Peripherally outwardly from the enclosure 30 (that is spaced outwardly from the side and back walls 34, 36), the inner wall 32 defines a series of holes 44 to enable the inner wall, and hence the entire housing 12, to be secured to the door member A. Typically the inner wall 32 will be back-mounted to the member A, as illustrated, by means of outwardly driven screws 46 which do not extend all the way through the inner wall holes 44 to prevent tampering therewith. Alternatively, the holes may extend all the way through the inner wall 32 and inwardly driven bolts may be used with only a flat or round surface being disposed on the outer side of the inner wall 32 and the nut being disposed on the inner portion of the member A, again to discourage attempted manipulation of the bolts by thieves.

While the enclosure 30 defined by housing 12 is itself open at one side, when the housing 12 is secured to the member A the open side of the enclosure 30 is closed by the member A, which acts as the inner surface of the enclosure 30 where the actual housing inner wall 32 is cut away. While the lock body 10 is replaceable within the enclosure 30 once the housing 12 has been separated from the member A (for example, so that a defective lock body 10 can be replaced), so long as the housing 12 remains secured to the member A, the lock body 10 is secured within the enclosure 30.

Similarly, while the enclosure 30 defined by the housing 12 is open in the same forward direction as the shackle-receiving apertures 22, thereby at least in part defining the aperture access openings 42, in order to prevent withdrawal of the lock body 10 from the enclosure 30 through the front thereof, there is disposed with the enclosure 30, operatively secured to the housing 12 and engageable with the lock body 10, means 50 for retaining the lock body 10 within the enclosure 30 by limiting forward motion of the lock body 10 relative to the housing 12. As illustrated, the retaining means 50 comprises a lug extending inwardly from the outer wall 38 toward the plane of the inner wall 32, at a point spaced forwardly of the back wall 36 and intermediate the shackle-receiving apertures. If desired, alternatively lug 50 may be directly secured to the member A and extend outwardly therefrom towards outer wall 38, such a lug still being operatively secured to the housing 12 due to bolts 46. As illustrated, the lug 50 occupies the recess 16 formed at the front of the lock body 10, but obviously if a lock body with an internal hole (that is, one spaced from the front of the lock body) were employed, the lug would simply be repositioned so as to enter that aperture. In any case the lug is preferably configured and dimensioned to just slightly squeeze the lock body 10 against the enclosure 30 surrounding it, thereby to assist through a friction-fit in maintaining the lock body 10 in the enclosure 30 as the housing 12 is being mounted on the member A.

The shackle-bearing element, generally designated by the numeral 14, includes a body portion 52 and a shackle 54 carried thereby. The body portion 52 comprises an upstanding outwardly directed portion 56 defining holes 44 for passage therethrough of bolts 46, the bolts 46 being used to affix the portion 56, and hence the element 14, to the second member B. The shackle-bearing element 14 is adapted to be secured to the second member B such that the shackle 54 is aligned with and enters the housing aperture access openings 42, and then the lock body apertures 22 themselves, as the first and second members A, B approach each other. The shackle-bearing element 14 is secured to the member B in such a way that most of the body portion 52 extends closer to the member A than the near edge of member B. For example, typically, only the upstanding portion 56 of element 14 overlaps member B with the remainder 57 of the body portion 52 projecting rearwardly and being configured and dimensioned to cover substantially all portions of the housing aperture access openings 42 not occupied by the shackle 54 when the shackle 54 is releasably retained in the shackle-receiving apertures 22.

This projecting body portion 57 is preferably of U-shaped configuration, thus enabling it to overlap snugly the outer surface of the housing 12 about the front part of the enclosure 30. Thus, the projecting body portion 57 overlaps portions of housing inner wall 32, side walls 34 and outer wall 38 when the upstanding portion 56 abuts the front portions of the same walls as well as the front of the lug 50 and lock body 10. Thus the body portion 52 of element 14 substantially closes the enclosure 30 (except for the keyhole access opening 40) and in effect, seals the lock body/shackle sub-assembly against destructive access. Indeed, only the keyhole access opening 40 of housing 12 and the keyhole 18 of the lock body 10 are subject to destructive access. Most importantly, for the most part the highly susceptible interface between the lock body 10 and shackle 54 is particularly well shielded by a double layer of housing 12 and element 14.

The housing 12 and the element 14 are preferably made of drill-resistant, case hardened steel.

Installation of the lug assembly is extremely simple, requiring only the drilling of holes, corresponding to holes 44 of the housing 12 and element 14, in the members A and B, respectively, and the use of bolts or screws 46 as aforedescribed to connect the housing 12 and element 14 to the members A and B, respectively. The housing 12 is inserted with a lock body 10 already placed in the enclosure 30 with the lug 50 occupying the recess 16. To replace a lock body 10, it is only necessary to separate the members A, B, remove the bolts or screws 46, and displace the housing 12 from member A. The lock body 10 can then be easily replaced, and the housing 12 resecured to the member A, as before.

The only installation skill required is to insure that the shackle 54 and shackle-receiving apertures 22 are appropriately aligned and that the element 14 projects rearwardly sufficiently beyond the member B so that, in effect, the forward face of housing 12 snugly abuts the rear surface of element 14, thereby to avoid any gaps or discontinuities upon which a thief may enlarge using a crowbar.

Once the lock assembly is properly installed, the members A, B need only be brought together and the shackle and lock body elements will lock. To separate such elements, it is only necessary to insert the key 20 through the keyhole access opening 40 and into the keyhole 18, whereupon the members A, B can be separated. If one employs a type of lock body requiring a key rotation, then, of course, the keyhole and keyhole access opening will have to be sufficiently spaced apart from inner wall 32 to enable rotation of the key therein, as well as its insertion into the lock body.

To summarize, the present invention provides a lock assembly which is shielded sufficiently to substantially limit to the keyhole any destructive access to the lock body or shackle. The lock body is replaceable, and the entire assembly is easy to manufacture, easy to install and reliable in operation.

While the present invention is described herein in the context of sliding doors, it will be appreciated that the principle is equally applicable to swinging doors where the shackle-bearing element or housing/lock body subassembly element is attached to either the swinging door or the door jamb and the other element to the door jamb or swinging door. Typically the shackle-bearing element would be attached to the swinging door and the housing/lock body subassembly element attached to the door jamb. For use in this environment, the shackle would have to be undersized or the shackle-receiving apertures of the lock body would have to be oversized, the purpose in either case being to accommodate the variation in angular disposition of the shackle as it enters the lock body. Similarly, all the remaining abutting surfaces of the shackle-bearing element and the housing would have to be modified to enable compensation for the angular variations as the door approaches the closed position. The need to maintain a certain amount of free play between the shackle and the shackle-receiving aperture and between the housing and the shackle-bearing element renders such an embodiment more susceptible to destructive access, however, and this should be appreciated as a disadvantage of such an embodiment.

Now that the preferred embodiments of the present invention have been shown and described, various modifications and improvements will become readily apparent to those skilled in the art. Accordingly, the spirit and scope of the present invention is to be limited only by the appended claims, and not by the foregoing disclosure.

I claim:

1. A shielded lock assembly suitable for joining first and second members together comprising in combination:

(A) a shackle-bearing element having a body portion and a shackle carried thereby;

(B) a lock body having a keyhole and having a shackle-receiving aperture opening in a given direction and adapted to receive and releasably retain said shackle therein;

(C) a housing adapted to be secured to the first member and having an enclosure adapted to receive said lock body and having access openings communicating with said shackle-receiving aperture and said keyhole, respectively; and (D) means operatively connected to said housing and engageable with said lock body for retaining said lock body in said enclosure;

said shackle-bearing element being adapted to be secured to the second member such that said shackle is aligned with and enters said shackle-receiving aperture as the first and second members approach each other, said body portion thereof being configured and dimensioned to then cover substantially all portions of said aperture access opening in said housing not occupied by said shackle.

2. The assembly of claim 1 wherein said enclosure is open at one side and adapted to be closed at said one side by the first member when said housing is secured thereto.

3. The assembly of claim 2 wherein said lock body is maintained within said enclosure by the first member when said housing is secured to the first member and is removable from said housing when said housing is not secured to the first member.

4. The assembly of claim 1 wherein said enclosure is open in said given direction, thereby at least in part defining said aperture access opening, and said retaining means limits movement of said lock body in said given direction.

5. The assembly of claim 1 wherein, when said housing is secured to the first member and said shackle-receiving aperture receives said shackle, said shackle-bearing element substantially closes said enclosure except for said keyhole access opening.

6. The assembly of claim 1 wherein said housing has at least two spaced apart side walls, a back wall joining said side walls, and an outer wall joining said back and side walls, said walls cooperatively defining said enclosure.

7. The assembly of claim 6 wherein said housing further defines a substantially planar inner wall, said back and side walls being upstanding from said inner wall.

8. The assembly of claim 7 wherein said retaining means comprises a lug extending from said outer wall towards the plane of said inner wall.

9. The assembly of claim 7 wherein said inner wall is cut away to enable direct contact between said lock body and the first member.

10. The assembly of claim 7 wherein said element body portion overlaps portions of said inner, side and outer walls when said shackle enters said shackle-receiving aperture.

11. A shielded lock assembly suitable for joining first and second members together comprising in combination:

(A) a shackle-bearing element having a body portion and a shackle carried thereby;

(B) a lock body having a keyhole and having a shackle-receiving aperture opening in a given direction and adapted to receive and releasably retain said shackle therein;

(C) a housing adapted to be secured to the first member and having an enclosure adapted to receive said lock body and having access openings communicating with said shackle-receiving aperture and said keyhole, respectively, said housing having at least two spaced apart side walls, a back wall joining said side walls, and an outer wall joining said back and side walls, said walls cooperatively defining said enclosure; and (D) means operatively connected to said housing and engageable with said lock body for retaining said lock body in said enclosure;

said shackle-bearing element being adapted to be secured to the second member such that said shackle is aligned with and enters said shackle-receiving aperture as the first and second members approach each other, said body portion thereof being configured and dimensioned to then cover substantially all portions of said aperture access opening in said housing not occupied by said shackle, said retaining means comprising a lug extending inwardly from said outer wall at a point spaced forwardly from said back wall.

12. The assembly of claim 11 wherein said lug is disposed intermediate a pair of said shackle-receiving apertures.

13. A shielded lock assembly suitable for joining first and second members together comprising in combination;

(A) a shackle-bearing element having a body portion and a shackle carried thereby;

(B) a lock body having a keyhole and having a shackle-receiving aperture opening in a given direction and adapted to receive and releasably retain said shackle therein;

(C) a housing adapted to be secured to the first member and having an enclosure adapted to receive said lock body and having access openings communicating with said shackle-receiving aperture and said keyhole, respectively, said housing having at least two spaced apart side walls, a back wall joining said side walls, and an outer wall joining said back and side walls, said walls cooperatively defining said enclosure; and (D) means operatively connected to said housing and engageable with said lock body for retaining said lock body in said enclosure;

said shackle-bearing element being adapted to be secured to the second member such that said shackle is aligned with and enters said shackle-receiving aperture as the first and second members approach each other, said body portion thereof being configured and dimensioned to then cover substantially all portions of said aperture access opening in said housing not occupied by said shackle and to overlap a portion of said side and outer walls of said housing when said shackle enters said shackle-receiving aperture.

14. The assembly of claim 1 wherein said shackle-bearing element is adapted to be secured to the second member and said housing is adapted to be secured to said first member and receive said lock body therein such that the joining of said first and second members together automatically causes said shackle to enter said shackle-receiving aperture and said body portion of said shackle-bearing element to cover substantially all portions of said aperture access opening in said housing not occupied by said shackle, without further manipulation.

* * * * *